US010611985B2

(12) United States Patent
Delplancke et al.

(10) Patent No.: US 10,611,985 B2
(45) **Date of Patent: *Apr. 7, 2020**

(54) LIQUID DETERGENT COMPOSITION

(71) Applicant: The Procter & Gamble Company, Cincinnati, OH (US)

(72) Inventors: Patrick Firmin August Delplancke, Steenhuize-Wijnhuize (BE); Karl Ghislain Braeckman, Gerpinnes (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/334,596

(22) Filed: Oct. 26, 2016

(65) Prior Publication Data

US 2017/0121637 A1 May 4, 2017

(30) Foreign Application Priority Data

Oct. 29, 2015 (EP) ..... 15192189
Sep. 20, 2016 (EP) ..... 16189754

(51) Int. Cl.
*C11D 1/29* (2006.01)
*C11D 1/75* (2006.01)
(Continued)

(52) U.S. Cl.
CPC ..... *C11D 1/75* (2013.01); *C11D 1/29* (2013.01); *C11D 1/72* (2013.01); *C11D 1/83* (2013.01);
(Continued)

(58) Field of Classification Search
CPC .... C11D 1/29; C11D 1/72; C11D 1/75; C11D 3/30; C11D 3/3723
(Continued)

(56) References Cited

U.S. PATENT DOCUMENTS 5,523,025 A 6/1996 Erilli
5,827,813 A * 10/1998 Hartman ..... C11D 1/40 510/443
(Continued)

FOREIGN PATENT DOCUMENTS

EP 1111031 A1 6/2001
WO WO99/27054 * 6/1999
(Continued)

OTHER PUBLICATIONS

Baxxodur ECX 210, BASF The Chemical Company, p. 1.*
(Continued)

*Primary Examiner* — Gregory R Delcotto
(74) *Attorney, Agent, or Firm* — Melissa G. Krasovec

(57) ABSTRACT

A liquid detergent composition having a pH of from 7.1 to less than 8.9 as measured at 10% solution in distilled water at 20° C. wherein the composition includes a surfactant system, the surfactant system including an anionic surfactant and a primary co-surfactant selected from the group consisting of amphoteric surfactant, zwitteronic surfactant and mixtures thereof wherein the anionic surfactant and the primary co-surfactant are in a weight ratio of from less than 10:1 to more than 2.5:1 and wherein the composition further includes a specific cyclic amine.

9 Claims, 1 Drawing Sheet

(51) Int. Cl.

| | |
|---|---|
| ***C11D 1/83*** | (2006.01) |
| ***C11D 3/30*** | (2006.01) |
| ***C11D 1/72*** | (2006.01) |
| ***C11D 11/00*** | (2006.01) |
| ***C11D 3/37*** | (2006.01) |

(52) U.S. Cl.
CPC ..... *C11D 3/30* (2013.01); *C11D 3/3723* (2013.01); *C11D 11/0023* (2013.01)

(58) Field of Classification Search
USPC ..... 510/237, 424, 427, 475, 499, 503
See application file for complete search history.

(56) References Cited

U.S. PATENT DOCUMENTS

| | | | | |
|---|---|---|---|---|
| 6,156,720 | A * | 12/2000 | Boeckh | C11D 3/0036 510/475 |
| 6,300,304 | B1 * | 10/2001 | Boeckh | C11D 3/0036 510/475 |
| 6,774,099 | B1 * | 8/2004 | Scheibel | C11D 1/83 510/357 |
| 8,318,653 | B2 * | 11/2012 | Misske | C08G 73/0206 510/360 |
| 9,193,939 | B2 | 11/2015 | Hulskotter et al. | |
| 9,487,739 | B2 | 11/2016 | Loughnane | |
| 9,540,592 | B2 | 1/2017 | Hulskotter et al. | |
| 9,617,502 | B2 | 4/2017 | Loughnane et al. | |
| 9,631,163 | B2 | 4/2017 | Hulskotter et al. | |
| 9,725,682 | B2 * | 8/2017 | Hulskotter | C11D 1/94 |
| 9,850,452 | B2 | 12/2017 | Fossum et al. | |
| 2010/0261634 | A1 * | 10/2010 | Misske | C08G 73/0206 510/299 |
| 2014/0121147 | A1 * | 5/2014 | Tajmamet | C11D 3/48 510/235 |
| 2014/0174478 | A1 * | 6/2014 | Letzelter | C11D 1/831 134/25.2 |
| 2014/0290694 | A1 * | 10/2014 | Uchiyama | C11D 1/12 134/6 |
| 2014/0296124 | A1 | 10/2014 | Hulskotter et al. | |
| 2014/0296127 | A1 | 10/2014 | Hulskotter et al. | |
| 2014/0323380 | A1 * | 10/2014 | Tajmamet | C11D 3/48 510/235 |
| 2015/0191681 | A1 * | 7/2015 | Gonzales | C11D 3/227 510/441 |
| 2015/0315573 | A1 * | 11/2015 | Monteleone | C12N 15/113 514/44 A |
| 2016/0052867 | A1 | 2/2016 | Ebert et al. | |
| 2017/0015943 | A1 * | 1/2017 | Braeckman | C11D 3/30 |
| 2017/0015948 | A1 * | 1/2017 | Johnson | C11D 3/40 |
| 2017/0015949 | A1 * | 1/2017 | Johnson | C11D 3/42 |
| 2017/0015951 | A1 * | 1/2017 | Johnson | C11D 1/83 |
| 2017/0121635 | A1 | 5/2017 | Delplancke et al. | |
| 2017/0121636 | A1 | 5/2017 | Delplancke et al. | |
| 2017/0306268 | A1 * | 10/2017 | Hulskotter | C11D 3/30 |

FOREIGN PATENT DOCUMENTS

| | | | |
|---|---|---|---|
| WO | WO9927054 | A1 | 6/1999 |
| WO | WO9927058 | A1 | 6/1999 |
| WO | WO9963034 | A1 | 12/1999 |
| WO | WO0012451 | A1 | 3/2000 |
| WO | WO00/63333 | * | 10/2000 |
| WO | WO006333 | A1 | 10/2000 |
| WO | WO2009007941 | A2 | 1/2009 |
| WO | WO2014084885 | A1 | 6/2014 |
| WO | WO2014154783 | A1 | 10/2014 |

OTHER PUBLICATIONS

European Search Report for Application No. 15192183.0-1358, dated Apr. 25, 2016, 5 pages.
European Search Report for Application No. 15192188.9-1358, dated Mar. 1, 2016, 7 pages.
European Search Report for Application No. 15192189.7-1358, dated Apr. 25, 2016, 5 pages.
Extended European Search Report for Application No. 16189754.1-1358, dated Mar. 10, 2017, 6 pages.
International Search Report for International Application Serial No. PCT/US2016/058730, dated Jan. 13, 2017, 12 pages.
International Search Report for International Application Serial No. PCT/US2016/058732, dated Jan. 23, 2017, 10 pages.
International Search Report for International Application Serial PCT/US2016/058733, dated Jan. 24, 2017, 10 pages.
Non-Final Office Action for U.S. Appl. No. 15/334,560, dated Apr. 5, 2018, 25 pages.
Non-Final Office Action for U.S. Appl. No. 15/334,582, dated Mar. 14, 2018, 37 pages.
Product Name: Baxxodur ECX 210, BASF The Chemical Company, p. 1 of 1, dated Aug. 11, 2010.

* cited by examiner

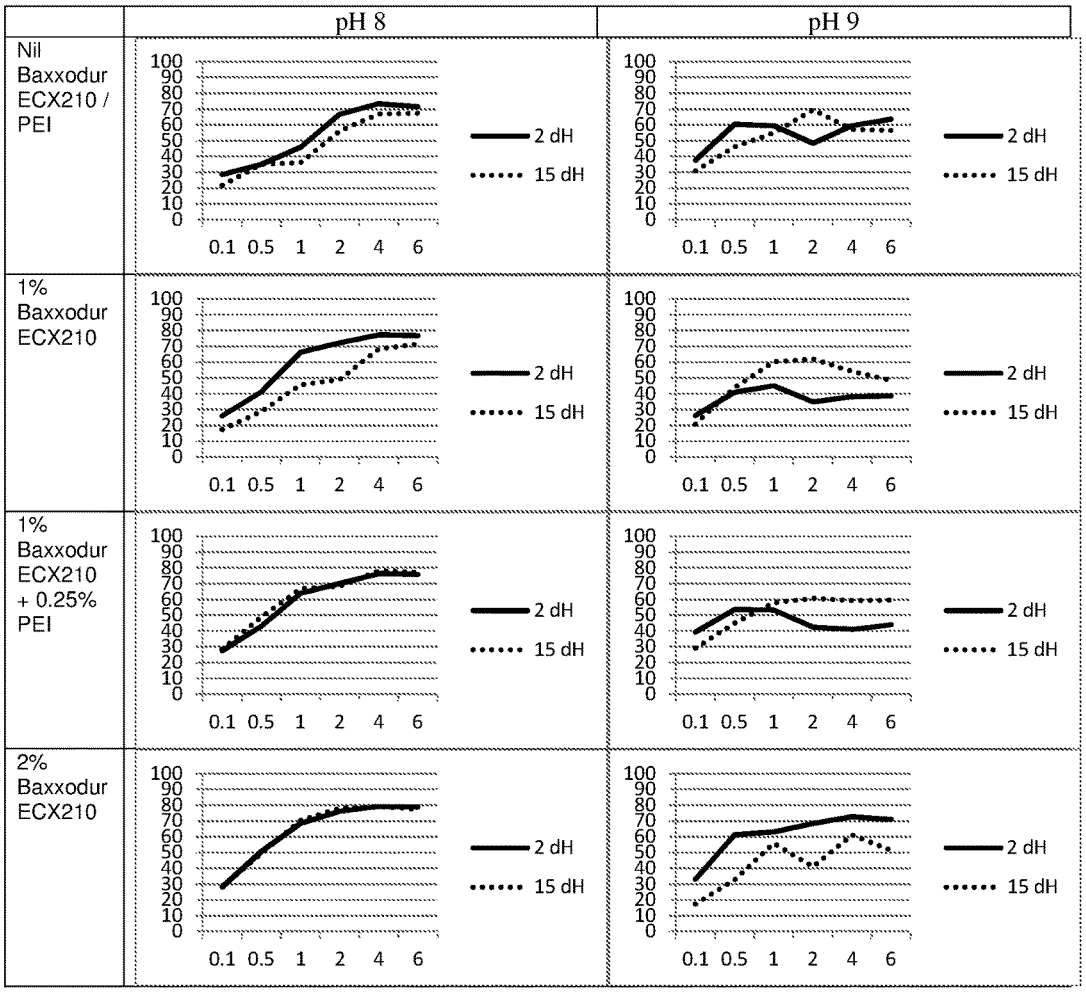
pH 8
pH 9
Nil Baxxodur ECX210 / PEI
1% Baxxodur ECX210
1% Baxxodur ECX210 + 0.25% PEI
2% Baxxodur ECX210
100
90
80
70
60
50
40
30
20
10
0
0.1 0.5 1 2 4 6
2 dH
15 dH

LIQUID DETERGENT COMPOSITION

FIELD OF THE INVENTION

The present invention relates to a liquid detergent composition which provides improved grease removal from hard surfaces including plastic and improved rinse feel. The composition has a high hardness tolerance and provides good grease cleaning across a range of dilutions.

BACKGROUND OF THE INVENTION

The detergent formulator is constantly aiming to improve the performance of detergent compositions. One of the biggest challenges encountered in hard surface cleaning is the removal of greasy soils, in particular the removal of greasy soils from dishware including hydrophobic items such as plastic.

In manual dishwashing, the challenge is not only to remove the grease from hydrophobic items but also to provide a good feeling during the rinse. Sometimes items can feel greasy or slippery during the rinse and this is disliked by users.

Accordingly, there is a need for a liquid detergent composition that provides good grease removal from dishware and at the same time does leave dishware free from slippery feeling during rinse.

Users have different washing habits. Some consumers like to wash in a sink full of water containing the dishwashing detergent, while others prefer to apply the dishwashing detergent onto the cleaning implement and wash under running water. Consequently, a hand dishwashing detergent needs to be designed to perform well under a wide range of dilutions. Other variable that needs to be taken into account in the design of a dishwashing detergent is the hardness of the water. Different hardness can have different effects on the performance of dishwashing detergents.

There is also a need for a cleaning composition that provides good grease cleaning across a range of water hardness and dilutions.

Dishwashing detergents based on surfactants systems can be prone to separation of the different components of the system impairing on the cleaning performance. Separation can occur in the product per se or in use. Thus, there is also a need of a product that does not present separation issues.

SUMMARY OF THE INVENTION

The present invention addresses these needs by providing a liquid detergent composition having a specific pH as measured in a 10% weight solution in distilled water at 20° C. The composition comprises a specific surfactant system and a specific cyclic diamine. The detergent composition is preferably a hand dishwashing detergent composition. The surfactant system comprises an anionic surfactant and a primary co-surfactant in a specific weight ratio and optionally but preferably a secondary co-surfactant. The primary co-surfactant is selected from the group consisting of amphoteric surfactant, zwitteronic surfactant and mixtures thereof. The weight ratio of anionic surfactant to primary co-surfactant is from less than 10:1 to more than 2.5:1, preferably from less than 9:1 to more than 2.6:1, more preferably from 6:1 to 2.8:1, most preferably from 5:1 to 3:1.

The pH of the composition is from 7.1 to 8.9, preferably from 7.2 to 8.5, more preferably from 7.5 to 8.2 as measured at 10% weight solution in distilled water at 20° C.

One advantage of the present invention is that it does not provide slippery feeling on washed items and provide very efficient grease removal. Furthermore, the composition is very robust across hardness and dilution levels and it does not separate. Specially preferred anionic surfactant to primary co-surfactant weight ratio, in terms of grease removal, lack of slippery feeling and performance across a range of hardness and dilutions is a ratio of from 9:1 to 2.6:1 preferably of from 6:1 to 2.8:1, most preferably of from 5:1 to 3:1.

Preferred cyclic amines for use herein include 2-methylcyclohexane-1,3-diamine, 4-methylcyclohexane-1,3-diamine and mixtures thereof. Compositions comprising these diamines provide very good grease removal from dishware and the dishware does not feel slippery during rinse.

The anionic surfactant can be any anionic cleaning surfactant, preferably the anionic surfactant comprises a sulphate anionic surfactant, more preferably an alkyl sulphate and/or alkoxylated sulfate anionic surfactant, preferably an alkyl alkoxylated anionic surfactant having an average alkoxylation degree of from about 0.2 to about 3, preferably from about 0.2 to about 2, most preferably from about 0.2 to about 1.0. Also preferred are branched anionic surfactants having a weight average level of branching of from about 5% to about 40%, more preferably alkyl alkoxylated anionic surfactants having a weight average level of branching of from about 5% to about 40%. Especially preferred anionic surfactant for use herein is an alkyl alkoxylated anionic surfactant having an average alkoxylation degree of from about 0.2 to about 1 and a weight average level of branching of from about 5% to about 40%.

Preferably the composition of the invention comprises from about 1% to about 40%, preferably from about 6% to about 32%, more preferably from about 8% to about 25% by weight of the composition of the surfactant system. Preferably the composition of the invention comprises from about 5% to about 30% by weight of the composition of anionic surfactant.

Preferably the primary co-surfactant comprises amine oxide, more preferably the primary co-surfactant comprises at least 60% of amine oxide surfactant by weight of the primary co-surfactant. Preferably the primary co-surfactant comprises more than 80%, more preferably more than 99% by weight of the primary co-surfactant of amine oxide. Preferred amine oxide surfactant for use herein is an alkyl dimethyl amine oxide.

Preferably, the composition of the invention comprises a hydrotrope, more preferably sodium cumene sulfonate. The hydrotrope helps with the rheology profile of the composition. In particular it helps to thin the composition upon dilution that can contribute to faster release of cleaning actives and faster cleaning. This can be more important when the composition is used in manual dishwashing and the manual dishwashing takes place by delivering the composition onto a cleaning implement rather than delivering the composition onto a sink full of water.

Preferably, the composition of the invention comprises an amphiphilic polymer, selected from the group consisting of amphiphilic alkoxylated polyalkyleneimine, amphiphilic graft polymer and mixtures thereof. Compositions comprising an amphiphilic polymer provide very good grease cleaning and prevent strong thickening upon dilution, in particular when the composition is used in neat form, as opposite to being diluted in a full sink of water. The amphiphilic polymer contributes to the generation of flash suds.

Preferably, the amphiphilic alkoxylated polyalkyleneimine is an alkoxylated polyethyleneimine polymer comprising a polyethyleneimine backbone having from about 400 to about 5,000 weight average molecular weight and the alkoxylated polyethyleneimine polymer further comprises:

(1) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a $C_1$-$C_4$ alkyl or mixtures thereof;

(2) an addition of one $C_1$-$C_4$ alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a $C_1$-$C_4$ alkyl or mixtures thereof; or (3) a combination thereof; and wherein the alkoxy moieties comprises ethoxy (EO) and/or propoxy (PO) and/or butoxy and wherein when the alkoxylation modification comprises EO it also comprises PO or BO.

Preferably, the weight average molecular weight per polyalkoxylene chain is from 400 to 8,000, the weight average molecular weight of the alkoxylated polyethyleneimine is from 8,000 to 40,000 and the polyalkoxylene chain comprises a propoxy moiety in a terminal position.

Preferably, the polyalkoxylene chain comprises ethoxy and propoxy moieties in a ratio of 1:1 to 2:1.

Extremely useful for use herein have been found alkoxylated polyalkyleneimines in which the number of ethoxy moieties of a polyalkoxylene chain is from 22 to 26, and the number of propoxy moieties is from 14 to 18 and preferably the polyalkoxylene chain is free of butoxy moieties.

Preferably, the amphiphilic graft polymer is a random graft copolymer having a hydrophilic backbone comprising monomers selected from the group consisting of unsaturated C3-6 acids, ethers, alcohols, aldehydes, ketones or esters, sugar units, alkoxy units, maleic anhydride and saturated polyalcohols such as glycerol, and mixtures thereof, and hydrophobic side chains selected from the group comprising a C4-25 alkyl group, polypropylene; polybutylene, a vinyl ester of a saturated monocarboxylic acid containing from 1 to 6 carbon atoms; a C1-6 alkyl ester of acrylic or methacrylic acid; and a mixture thereof.

Preferably, the amphiphilic graft polymer has a hydrophilic backbone comprising polyethylene glycol of molecular weight from 4,000 to 15,000, and from 50% to 65% by weight hydrophobic side chains formed by polymerising at least one monomer selected from a vinyl ester of a saturated monocarboxylic acid containing from 1 to 6 carbon atoms and/or a C1-6 alkyl ester of acrylic or methacrylic acid.

Preferably, the amphiphilic graft polymer has a hydrophilic backbone comprising polyethylene glycol of molecular weight from 4,000 to 15,000, and from 50% to 65% by weight hydrophobic side chains formed by polymerising at least one monomer selected from vinyl acetate, vinyl propionate and/or butyl acrylate.

Preferably, the amphiphilic graft polymer is based on water-soluble polyalkylene oxides comprising alkylene oxide units (A) as a backbone and side chains formed by polymerization of a vinyl ester component (B), said polymer having an average of less than 1 graft site per 50 alkylene oxide units and mean molar masses Mw of from 3000 to 100 000.

Preferably, the amphiphilic graft polymer has a polydispersity Mw/Mn of less or equal than 3.

Preferably, the amphiphilic graft polymer comprises less than 10% by weight of polyvinyl ester (B) in ungrafted form.

Preferably, the amphiphilic graft polymer has (A) from 20% to 70% by weight of a water-soluble polyalkylene oxide as a backbone and (B) side chains formed by free-radical polymerization of from 30% to 80% by weight of a vinyl ester component composed of (B1) from 70% to 100% by weight of vinyl acetate and/or vinyl propionate and (B2) from 0 to 30% by weight of a further ethylenically unsaturated monomer in the presence of (A).

A preferred amphiphilic graft polymer is obtainable by free-radical polymerization of (B) from 30% to 80% by weight of a vinyl ester component composed of (B1) from 70% to 100% by weight of vinyl acetate and/or vinyl propionate and (B2) from 0 to 30% by weight of a further ethylenically unsaturated monomer, in the presence of (A) from 20% to 70% by weight of a water-soluble polyalkylene oxide of mean molar mass Mn of from 1500 to 20 000, (C) from 0.25% to 5% by weight, based on component (B), of a free radical-forming initiator, and (D) from 0 to 40% by weight, based on the sum of components (A), (B) and (C), of an organic solvent at a mean polymerization temperature at which the initiator (C) has a decomposition half-life of from 40 to 500 min, is polymerized in such a way that the fraction of unconverted graft monomer (B) and initiator (C) in the reaction mixture is constantly kept in a quantitative deficiency relative to the polyalkylene oxide (A).

According to another aspect of the invention there is provided a method of manual dishwashing using the composition of the invention.

There is also provided the use of the composition of the invention to provide grease cleaning and good feel during rinse.

The elements of the composition of the invention described in connection with the first aspect of the invention apply mutatis mutandis to the other aspects of the invention.

BRIEF DESCRIPTION OF THE DRAWINGS

FIG. 1 is a graphical representation of grease cleaning performance assessment.

DETAILED DESCRIPTION OF THE INVENTION

As used herein "liquid detergent composition" refers to those compositions that are employed in a variety of cleaning uses including dishes, or hard surfaces (e.g., floors, countertops etc), laundry, hair (e.g., shampoos), body, and the like. A preferred liquid detergent composition of the present invention is a "liquid dish detergent composition," which refers to those compositions that are employed in manual (i.e. hand) dish washing. Such compositions are generally high sudsing or foaming in nature. By "dish," the term include dishes, glasses, pots, pans, baking dishes, flatware and the like, made from ceramic, china, metal, glass, plastic (polyethylene, polypropylene, polystyrene, etc.), wood and the like. The composition of the invention is particularly good for the removal of grease from dishware, including plastic items and it performs very well across a broad range of hardness and dilutions.

Surfactant System

The surfactant system of the composition of the invention comprises an anionic surfactant, a primary co-surfactant and optionally but preferably a secondary co-surfactant. The liquid detergent composition comprises from about 1% to about 40%, preferably from about 6% to about 32%, more preferably from about 8% to about 25% by weight of the composition of the surfactant system.

Anionic Surfactant

The composition of the invention preferably comprises from 1% to 40%, more preferably 6% to 32% and especially from 8% to 25% of anionic surfactant by weight of the composition.

The anionic surfactant can be a single surfactant but usually it is a mixture of anionic surfactants. Preferably the anionic surfactant comprises a sulfate surfactant, more preferably a sulfate surfactant selected from the group consisting of alkyl sulfate, alkyl alkoxy sulfate and mixtures thereof. Preferred alkyl alkoxy sulfates for use herein are alkyl ethoxy sulfates.

The alkyl sulphate surfactant of the present invention preferably have the formula: $R_1O(A)_xSO_3M$, wherein the variables are herein defined. "$R_1$" is a $C_1$-$C_{21}$ alkyl or alkenyl group, preferably from $C_8$-$C_{20}$, more preferably from $C_{10}$-$C_{18}$. The alkyl or alkenyl group may be branched or linear. Where the alkyl or alkenyl group is branched, it preferably comprises $C_{1-4}$ alkyl branching units. The average weight percentage branching of the alkyl sulphate surfactant is preferably greater than 10%, more preferably from 15% to 80%, and most preferably from 20% to 40%, alternatively from 21% to 28%, alternatively combinations thereof. The branched alkyl sulphate surfactant can be a single alkyl sulphate surfactant or a mixture of alkyl sulphate surfactants. In the case of a single surfactant, the percentage of branching refers to the weight percentage of the hydrocarbyl chains that are branched in the original alcohol from which the surfactant is derived. In the case of a surfactant mixture, the percentage of branching is the weight average and it is defined according to the following formula: Weight average of branching (%)=[(x1*wt % branched alcohol 1 in alcohol 1+x2*wt % branched alcohol 2 in alcohol 2+ . . . )/(x1+x2+ . . . )]*100; wherein x1, x2, are the weight in grams of each alcohol in the total alcohol mixture of the alcohols which were used as starting material for the anionic surfactant. In the weight average branching degree calculation the weight of alkyl sulphate surfactant components not having branched groups should also be included.

Turning back to the above formula, "A" is an alkoxy group, preferably a $C_1$-$C_5$ alkoxy group, more preferably a $C_1$-$C_3$ alkoxy group, yet more preferably the alkoxy group is selected from ethoxy, propoxy, and mixtures thereof. In one embodiment, the alkoxy group is ethoxy. "x" represents a mole percentage average below 1, preferably from 0 to below 1, more preferably from 0.1 to 0.9, alternatively from 0.2 to 0.8, alternatively combinations thereof.

For purposes of clarification, the formula above describes certain alkyl alkoxy sulfates; more preferably the formula describes a mixture of alkyl sulfates and alkyl alkoxy sulfates such that the alkoxylation on mole percentage average (i.e., variable "x") is below 1. In the case of a surfactant mixture, the average degree of alkoxylation is the mole percent average and it is defined according to the following formula: Mole average degree of alkoxylation= [(y0*0+y1*1+y2*2+ . . . )/(y0+y1+y2+ . . . )]; wherein y0, y1, y2, . . . are the mole percent of each sulphated surfactant in the total alkyl mixture of sulphated surfactants having respectively 0, 1, 2, alkoxy units which are present in the detergent of the invention. For example, an alkyl sulphate of the following formula $CH_3(CH_2)_{13}SO_4$ Na will have a y value of 0 (i.e., y0). An alkylethoxysulfate of the following formula $CH_3(CH_2)_{13}(OCH_2CH_2)SO_4$ Na will have a y value of 1 (i.e., y1). An alkylethoxysulfate of the following formula: $CH_3(CH_2)_{10}(OCH_2CH_2)_4SO_4$ Na will have an y value of 4 (i.e., y4). The mole amount of each the three molecules is taken into account to ultimately calculate the mole percentage average of variable "x" (in the formula $R_1O(A)_xSO_3M$).

Regarding the formula $R_1O(A)_xSO_3M$, "M" is a cation, preferably the cation is selected from an alkali metal, alkali earth metal, ammonium group, or alkanolammonium group; more preferably the cation is sodium.

The detergent composition can optionally further comprise other anionic surfactants. Non-limiting examples include sulphonate, carboxylate, sulfosuccinate and sulfoacetate anionic surfactants.

Primary Co-Surfactant

The composition of the invention comprises a primary co-surfactant. The composition preferably comprises from 0.1% to 20%, more preferably from 0.5% to 15% and especially from 2% to 10% by weight of the composition. The primary co-surfactant is selected from the group consisting of an amphoteric surfactant, a zwitterionic surfactant, and mixtures thereof. The composition of the present invention will preferably comprise an amine oxide as the amphoteric surfactant or betaine as the zwitterionic surfactant, or a mixture of said amine oxide and betaine surfactants.

Preferably the primary co-surfactant comprises an amphoteric surfactant. The amphoteric surfactant preferably comprises at least 40%, more preferably at least 50%, more preferably at least 60% and especially at least 80% by weight of an amine oxide surfactant. Alternatively the primary co-surfactant comprises an amphoteric and a zwitterionic surfactant, preferably the amphoteric and the zwitterionic surfactant are in a weight ratio of from about 2:1 to about 1:2, more preferably the amphoteric surfactant is an amine oxide surfactant and the zwitteronic surfactant is a betaine. Most preferably the co-surfactant is an amine oxide, especially alkyl dimethyl amine oxide.

Most preferred among the amphoteric surfactants are amine oxides, especially coco dimethyl amine oxide or coco amido propyl dimethyl amine oxide. Amine oxide may have a linear or mid-branched alkyl moiety. Typical linear amine oxides include water-soluble amine oxides containing one R1 $C_{8-18}$ alkyl moiety and 2 R2 and R3 moieties selected from the group consisting of $C_{1-3}$ alkyl groups and $C_{1-3}$ hydroxyalkyl groups. Preferably amine oxide is characterized by the formula R1-N(R2)(R3) 0 wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides.

Most preferred among the zwitterionic surfactants are betaines, such as alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y—$$ (I) wherein $R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n is a number from 1 to 10, preferably 2 to 5, in particular 3, x is 0 or 1, preferably 1, $R^2$, $R^3$ are independently a C1-4 alkyl residue, potentially hydroxy substituted such as a hydroxyethyl, preferably a methyl.

m is a number from 1 to 4, in particular 1, 2 or 3, y is 0 or 1 and

Y is COO, SO3, OPO(OR5)O or P(O)(OR5)O, whereby R5 is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

$$R^1—N^+(CH_3)_2—CH_2COO^- \quad (Ia)$$

$$R^1—CO—NH(CH_2)_3—N^+(CH_3)_2—CH_2COO^- \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which $R^1$1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropyl betaines (Cocoamidopropylbetain).

Secondary Co-Surfactant

Preferably the composition of the invention comprises a non-ionic surfactant as secondary co-surfactant. Preferably from 0.1 to 10%, more preferably from 1% to 8%, especially from 0.2% to 1% or from 3% to 6% of a nonionic surfactant by weight of the composition. Suitable nonionic surfactants include the condensation products of aliphatic alcohols with from 1 to 25 moles of alkylene oxide, preferably ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 8 to 18 carbon atoms, preferably from 10 to 15 carbon atoms, alternatively from 9 to 11 carbon atoms, alternatively from 12 to 14 carbon atoms, alternatively combinations thereof; with from 2 to 18 moles, preferably 2 to 15 moles, more preferably 5 to 12 moles of ethylene oxide per mole of alcohol. A preferred non-ionic surfactant includes an aliphatic alcohol with from 1 to 25 moles of ethylene oxide, preferably condensation products of alcohols having an alkyl group containing from 8 to 18 carbon atoms, with from 2 to 18 moles of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants having the formula (IV):

$$R^6\overset{\overset{\displaystyle O}{\|}}{C}N(R^7)_2 \quad (IV)$$

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and —$(C_2H_4O)_xH$ where x of formula (IV) varies from 1 to 3. Preferred amides are $C_8$-$C_{20}$ ammonia amides, monoethanolamides, diethanolamides, and isopropanolamides.

Most preferably the nonionic surfactant is a condensation product of an aliphatic alcohol with ethyleneoxide.

Preferably, the compositions of the present invention are free or substantially free of cationic surfactant.

Cyclic Amine

The composition of the invention preferably comprises from about 0.1% to about 10%, more preferably from about 0.2% to about 5%, and especially from about 0.3% to about 2%, by weight of the composition, of an amine of Formula (I).

The term "cyclic amine" herein encompasses a single amine and a mixture thereof. The amine can be subjected to protonation depending on the pH of the cleaning medium in which it is used.

The cyclic amine of the invention is a cleaning amines. By "cleaning amine" is herein meant a molecule, having the formula depicted herein below, comprising amine functionalities that helps cleaning as part of a cleaning composition.

The amine of the invention conforms to the following formula:

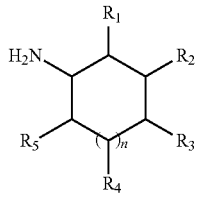

The substituents "Rs" can be independently selected from NH2, H and linear, branched alkyl or alkenyl from 1 to 10 carbon atoms. For the purpose of this invention "Rs" includes R1-R5. At least one of the "Rs" needs to be NH2. The remaining "Rs" can be independently selected from NH2, H and linear, branched alkyl or alkenyl having from 1 to 10 carbon atoms. n is from 0 to 3, preferably 1.

The amine of the invention is a cyclic amine with at least two primary amine functionalities. The primary amines can be in any position in the cycle but it has been found that in terms of grease cleaning, better performance is obtained when the primary amines are in positions 1,3. It has also been found advantageous in terms of grease cleaning amines in which one of the substituents is —CH3 and the rest are H.

Especially preferred for use herein are cleaning amines selected from the group consisting of 2-methylcyclohexane-1,3-diamine, 4-methylcyclohexane-1,3-diamine and mixtures thereof.

Amphiphilic Polymer

The composition of the invention preferably comprises from about 0.1% to about 2%, preferably from about 0.15% to about 1.5%, most preferably from about 0.2% to about 1% by weight of the composition of an amphiphilic polymer selected from the group consisting of amphiphilic alkoxylated polyalkyleneimine, amphiphilic graft polymer and mixtures thereof.

Amphiphilic Alkoxylated Polyalkyleneimine Amphiphilic alkoxylated polyethyleneimine polymers will comprise ethoxy (EO) and/or propoxy (PO) and/or butoxy (BO) groups within their alkoxylation chains. Preferred amphiphilic alkoxylated polyethylene polymers comprise EO and PO groups within their alkoxylation chains.

Hydrophilic alkoxylated polyethyleneimine polymers solely comprising ethoxy (EO) units within the alkoxylation chain are outside the scope of this invention.

The amphiphilic alkoxylated polyethyleneimine polymer of the composition of the invention has a polyethyleneimine backbone having from about 400 to about 5,000 weight average molecular weight, preferably from about 400 to about 2,000 weight average molecular weight, even more preferably from about 400 to about 1,000 weight average molecular weight, most preferably about 600 weight average molecular weight.

The alkoxylation chains within the amphiphilic alkoxylated polyethyleneimine polymer of the present composition have from about 400 to about 3,000 weight average molecular weight, preferably from about 600 to about 2,500 weight average molecular weight, more preferably from about 1,500 to about 2,250 weight average molecular weight, most preferably about 2,000 weight average molecular weight per alkoxylated chain.

The amphiphilic alkoxylated polyethyleneimine polymer of the present composition have from about 8,000 to about 40,000 weight average molecular weight, preferably from about 15,000 to about 35,000 weight average molecular weight, more preferably from about 25,000 to about 30,000 weight average molecular weight.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 50 alkoxy moieties per modification, wherein the terminal alkoxy moiety of the alkoxylation modification is capped with hydrogen, a $C_1$-$C_4$ alkyl or mixtures thereof; or (2) an addition of one $C_1$-$C_4$ alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 50 alkoxy moieties per modification wherein the terminal alkoxy moiety is capped with hydrogen, a $C_1$-$C_4$ alkyl or mixtures thereof, preferably hydrogen; or (3) a combination thereof.

For example, but not limited to, below is shown possible modifications to terminal nitrogen atoms in the polyethyleneimine backbone where R represents an ethylene spacer and E represents a $C_1$-$C_4$ alkyl moiety and $X^-$ represents a suitable water soluble counterion.

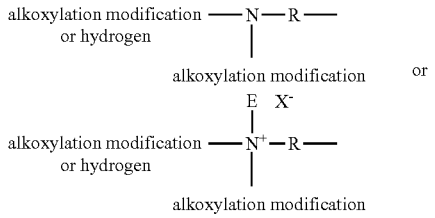

Also, for example, but not limited to, below is shown possible modifications to internal nitrogen atoms in the polyethyleneimine backbone where R represents an ethylene spacer and E represents a $C_1$-$C_4$ alkyl moiety and X— represents a suitable water soluble counterion.

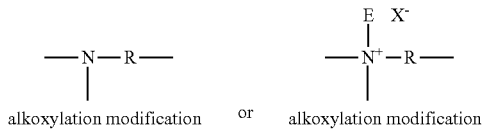

The alkoxylation modification of the polyethyleneimine backbone consists of the replacement of a hydrogen atom by a polyalkoxylene chain having an average of about 1 to about 50 alkoxy moieties, preferably from about 20 to about 45 alkoxy moieties, most preferably from about 30 to about 45 alkoxy moieties. The alkoxy moieties are selected from ethoxy (EO), propoxy (PO), butoxy (BO), and mixtures thereof. Alkoxy moieties solely comprising ethoxy units are outside the scope of the invention though. Preferably, the polyalkoxylene chain is selected from ethoxy/propoxy block moieties. More preferably, the polyalkoxylene chain is ethoxy/propoxy block moieties having an average degree of ethoxylation from about 3 to about 30 and an average degree of propoxylation from about 1 to about 20, more preferably ethoxy/propoxy block moieties having an average degree of ethoxylation from about 20 to about 30 and an average degree of propoxylation from about 10 to about 20.

More preferably the ethoxy/propoxy block moieties have a relative ethoxy to propoxy unit ratio between 3 to 1 and 1 to 1, preferably between 2 to 1 and 1 to 1. Most preferably the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized. Most preferably the degree of quaternization is 0%.

A preferred polyethyleneimine has the general structure of formula (I):

formula (I)

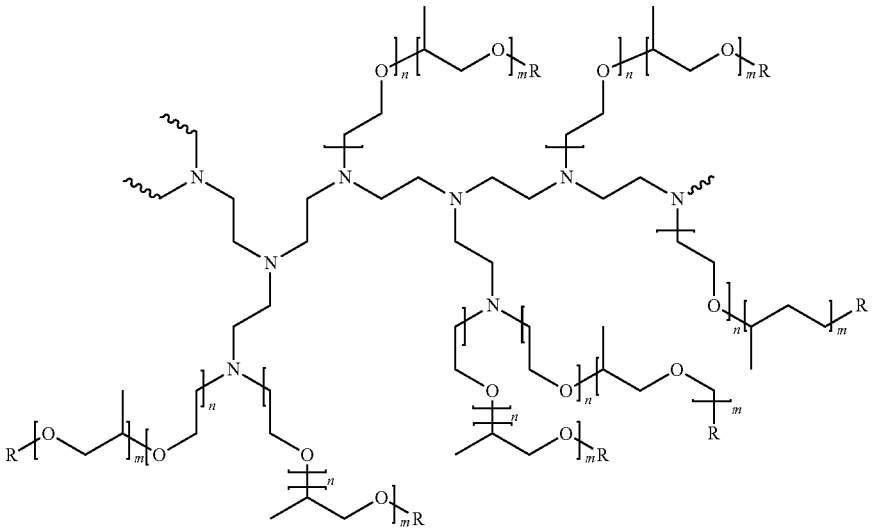

wherein the polyethyleneimine backbone has a weight average molecular weight of about 600, n of formula (I) has an average of about 10, m of formula (I) has an average of about 7 and R of formula (I) is selected from hydrogen, a $C_1$-$C_4$ alkyl and mixtures thereof, preferably hydrogen. The degree of permanent quaternization of formula (I) may be from 0% to about 22% of the polyethyleneimine backbone nitrogen atoms. The molecular weight of this polyethyleneimine preferably is between 10,000 and 15,000.

An alternative polyethyleneimine has the general structure of formula (I) but wherein the polyethyleneimine backbone has a weight average molecular weight of about 600, n of formula (I) has an average of about 24, m of formula (I) has an average of about 16 and R of formula (I) is selected from hydrogen, a $C_1$-$C_4$ alkyl and mixtures thereof, preferably hydrogen. The degree of permanent quaternization of formula (I) may be from 0% to about 22% of the polyethyleneimine backbone nitrogen atoms. The molecular weight of this polyethyleneimine preferably is between 25,000 and 30,000.

Most preferred polyethyleneimine has the general structure of formula (I) wherein the polyethyleneimine backbone has a weight average molecular weight of about 600, n of formula (I) has an average of about 24, m of formula (I) has an average of about 16 and R of formula (I) is hydrogen. The degree of permanent quaternization of formula (I) is 0% of the polyethyleneimine backbone nitrogen atoms. The molecular weight of this polyethyleneimine preferably is about from about 25,000 to 30,000, most preferably about 28,000.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like, as described in more detail in WO 2007/135645.

Amphiphilic Graft Polymer

The amphiphilic graft polymer herein is a random graft copolymer having a hydrophilic backbone and hydrophobic side chains. Typically, the hydrophilic backbone is less than about 70%, less than about 50%, or from about 50% to about 2%, or from about 45% to about 5%, or from about 40% to about 10% by weight of the polymer. The backbone preferably contains monomers selected from the group consisting of unsaturated C3-6 acid, ether, alcohol, aldehyde, ketone or ester, sugar unit, alkoxy unit, maleic anhydride and saturated polyalcohol such as glycerol, and a mixture thereof. The hydrophilic backbone may contain acrylic acid, methacrylic acid, maleic acid, vinyl acetic acid, glucoside, alkylene oxide, glycerol, or a mixture thereof. The polymer may contain either a linear or branched polyalkylene oxide backbone with ethylene oxide, propylene oxide and/or butylene oxide. The polyalkylene oxide backbone may contain more than about 80%, or from about 80% to about 100%, or from about 90% to about 100% or from about 95% to about 100% by weight ethylene oxide. The weight average molecular weight (Mw) of the polyalkylene oxide backbone is typically from about 400 g/mol to 40,000 g/mol, or from about 1,000 g/mol to about 18,000 g/mol, or from about 3,000 g/mol to about 13,500 g/mol, or from about 4,000 g/mol to about 9,000 g/mol. The polyalkylene backbone may be extended by condensation with suitable connecting molecules, such as dicarboxylic acids and/or diisocianates.

The backbone contains a plurality of hydrophobic side chains attached thereto, such as a C4-25 alkyl group; polypropylene; polybutylene; a vinyl ester of a saturated monocarboxylic C1-6 acid; and/or a C1-6 alkyl ester of acrylic or methacrylic acid. The hydrophobic side chains may contain, by weight of the hydrophobic side chains, at least about 50% vinyl acetate, or from about 50% to about 100% vinyl acetate, or from about 70% to about 100% vinyl acetate, or from about 90% to about 100% vinyl acetate. The hydrophobic side chains may contain, by weight of the hydrophobic side chains, from about 70% to about 99.9% vinyl acetate, or from about 90% to about 99% vinyl acetate. The hydrophobic side chains may also contain, by weight of the hydrophobic side chains, from about 0.1% to about 10% butyl acrylate, or from about 1% to about 7% butyl acrylate, or from about 2% to about 5% butyl acrylate. The hydrophobic side chains may also contain a modifying monomer, such as styrene, N-vinylpyrrolidone, acrylic acid, methacrylic acid, maleic acid, acrylamide, vinyl acetic acid and/or vinyl formamide, especially styrene and/or N-vinylpyrrolidone, at levels of from about 0.1% to about 10%, or from about 0.1% to about 5%, or from about 0.5% to about 6%, or from about 0.5% to about 4%, or from about 1% to about 3%, by weight of the hydrophobic side chains.

The polymer may be formed by grafting (a) polyethylene oxide; (b) a vinyl ester from acetic acid and/or propionic acid; and/or a C1-4 alkyl ester of acrylic or methacrylic acid; and (c) modifying monomers. The polymer may have the general formula:

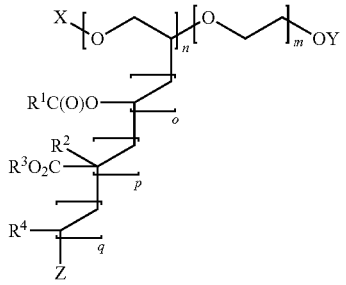

where X and Y are capping units independently selected from H or a C1-6 alkyl; each Z is a capping unit independently selected from H or a C-radical moiety (i.e., a carbon-containing fragment derived from the radical initiator attached to the growing chain as result of a recombination process); each R1 is independently selected from methyl and ethyl; each R2 is independently selected from H and methyl; each R3 is independently a C1-4 alkyl; and each R4 is independently selected from pyrrolidone and phenyl groups. The Mw of the polyethylene oxide backbone is as described above. The value of m, n, o, p and q is selected such that the pendant groups form at least 30%, at least 50%, or from about 50% to about 98%, or from about 55% to about 95%, or from about 60% to about 90% of the polymer, by weight. The polymer useful herein typically has a Mw of from about 1,000 g/mol to about 150,000 g/mol, or from about 2,500 g/mol to about 100,000 g/mol, or from about 7,500 g/mol to about 45,000 g/mol, or from about 10,000 g/mol to about 34,000 g/mol.

Preferred graft polymers for the present invention are amphiphilic graft polymers based on water-soluble polyalkylene oxides (A) as a graft base and side chains formed by polymerization of a vinyl ester component (B), said polymers having an average of three, preferably one graft site per 50 alkylene oxide units and mean molar masses Mw of from 3000 to 100 000.

A material within this definition, based on polyethylene oxide of molecular weight 6000 (equivalent to 136 ethylene oxide units), containing approximately 3 parts by weight of vinyl acetate units per 1 part by weight of polyethylene oxide, and having itself a molecular weight of 24 000, is commercially available from BASF as Sokalan (Trade Mark) HP22.

These graft polymers can be prepared by polymerizing a vinyl ester component (B) composed of vinyl acetate and/or vinyl propionate (B1) and, if desired, a further ethylenically unsaturated monomer (B2), in the presence of a water-soluble polyalkylene oxide (A), a free radical-forming initiator (C) and, if desired, up to 40% by weight, based on the sum of components (A), (B) and (C), of an organic solvent (D), at a mean polymerization temperature at which the initiator (C) has a decomposition half-life of from 40 to 500 min, in such a way that the fraction of unconverted graft monomer (B) and initiator (C) in the reaction mixture is constantly kept in a quantitative deficiency relative to the polyalkylene oxide (A).

The graft polymers are characterized by their low degree of branching (degree of grafting). They have, on average, based on the reaction mixture obtained, not more than 1 graft site, preferably not more than 0.6 graft site, more preferably not more than 0.5 graft site and most preferably not more than 0.4 graft site per 50 alkylene oxide units. They comprise, on average, based on the reaction mixture obtained, preferably at least 0.05, in particular at least 0.1 graft site per 50 alkylene oxide units. The degree of branching can be determined, for example, by means of 13C NMR spectroscopy from the integrals of the signals of the graft sites and the —CH2-groups of the polyalkylene oxide.

In accordance with their low degree of branching, the molar ratio of grafted to ungrafted alkylene oxide units in the inventive graft polymers is from 0.002 to 0.05, preferably from 0.002 to 0.035, more preferably from 0.003 to 0.025 and most preferably from 0.004 to 0.02.

More preferably, the graft polymers feature a narrow molar mass distribution and hence a polydispersity Mw/Mn of generally 3, preferably 2.5 and more preferably 2.3. Most preferably, their polydispersity Mw/Mn is in the range from 1.5 to 2.2. The polydispersity of the graft polymers can be determined, for example, by gel permeation chromatography using narrow-distribution polymethyl methacrylates as the standard.

The mean molecular weight Mw of the graft polymers is from 3000 to 100 000, preferably from 6000 to 45 000 and more preferably from 8000 to 30 000.

Owing to their low degree of branching and their low polydispersity, the amphiphilic character and the block polymer structure of the graft polymers is particularly marked.

The graft polymers also have only a low content of ungrafted polyvinyl ester (B). In general, they comprise 10% by weight, preferably 7.5% by weight and more preferably 5% by weight of ungrafted polyvinyl ester (B).

Owing to the low content of ungrafted polyvinyl ester and the balanced ratio of components (A) and (B), the graft polymers are soluble in water or in water/alcohol mixtures (for example a 25% by weight solution of diethylene glycol monobutyl ether in water). They have pronounced, low cloud points which, for the graft polymers soluble in water at up to 50° C., are generally 95° C., preferably 85° C. and more preferably 75° C., and, for the other graft polymers in 25% by weight diethylene glycol monobutyl ether, generally 90° C., preferably from 45 to 85° C.

The amphiphilic graft polymers have preferably (A) from 20% to 70% by weight of a water-soluble polyalkylene oxide as a graft base and (B) side chains formed by free-radical polymerization of from 30% to 80% by weight of a vinyl ester component composed of (B1) from 70% to 100% by weight of vinyl acetate and/or vinyl propionate and (B2) from 0 to 30% by weight of a further ethylenically unsaturated monomer, in the presence of (A).

More preferably, they comprise from 25% to 60% by weight of the graft base (A) and from 40% to 75% by weight of the polyvinyl ester component (B).

Water-soluble polyalkylene oxides suitable for forming the graft base (A) are in principle all polymers based on C2-C4-alkylene oxides which comprise at least 50% by weight, preferably at least 60% by weight, more preferably at least 75% by weight of ethylene oxide in copolymerized form.

The polyalkylene oxides (A) preferably have a low polydispersity Mw/Mn. Their polydispersity is preferably 1.5.

The polyalkylene oxides (A) may be the corresponding polyalkylene glycols in free form, i.e. with OH end groups, but they may also be capped at one or both end groups. Suitable end groups are, for example, C1-C25-alkyl, phenyl and C1-C14-alkylphenyl groups.

Specific examples of particularly suitable polyalkylene oxides (A) include:

(A1) polyethylene glycols which may be capped at one or both end groups, especially by C1-C25-alkyl groups, but are preferably not etherified, and have mean molar masses Mn of preferably from 1500 to 20 000, more preferably from 2500 to 15 000;

(A2) copolymers of ethylene oxide and propylene oxide and/or butylene oxide with an ethylene oxide content of at least 50% by weight, which may likewise be capped at one or both end groups, especially by C1-C25-alkyl groups, but are preferably not etherified, and have mean molar masses Mn of preferably from 1500 to 20 000, more preferably from 2500 to 15 000;

(A3) chain-extended products having mean molar masses of in particular from 2500 to 20 000, which are obtainable by reacting polyethylene glycols (A1) having mean molar masses Mn of from 200 to 5000 or copolymers (A2) having mean molar masses Mn of from 200 to 5000 with C2-C12-dicarboxylic acids or dicarboxylic esters or C6-C18-diisocyanates.

Preferred graft bases (A) are the polyethylene glycols (A1).

The side chains of the graft polymers are formed by polymerization of a vinyl ester component (B) in the presence of the graft base (A).

The vinyl ester component (B) may consist advantageously of (B1) vinyl acetate or vinyl propionate or of mixtures of vinyl acetate and vinyl propionate, particular preference being given to vinyl acetate as the vinyl ester component (B).

However, the side chains of the graft polymer can also be formed by copolymerizing vinyl acetate and/or vinyl propionate (B1) and a further ethylenically unsaturated monomer (B2). The fraction of monomer (B2) in the vinyl ester component (B) may be up to 30% by weight, which corresponds to a content in the graft polymer of (B2) of 24% by weight.

Suitable comonomers (B2) are, for example, monoethylenically unsaturated carboxylic acids and dicarboxylic acids and their derivatives, such as esters, amides and anhydrides, and styrene. It is of course also possible to use mixtures of different comonomers.

Specific examples include: (meth)acrylic acid, C1-C12-alkyl and hydroxy-C2-C12-alkyl esters of (meth)acrylic acid, (meth)acrylamide, N—C1-C12-alkyl(meth)acrylamide, N,N di(C1-C6-alkyl)(meth)acrylamide, maleic acid, maleic anhydride and mono(C1-C12-alkyl)esters of maleic acid.

Preferred monomers (B2) are the C1-C8-alkyl esters of (meth)acrylic acid and hydroxyethyl acrylate, particular preference being given to the C1-C4-alkyl esters of (meth) acrylic acid.

Very particularly preferred monomers (B2) are methyl acrylate, ethyl acrylate and in particular n-butyl acrylate.

When the graft polymers comprise the monomers (B2) as a constituent of the vinyl ester component (B), the content of graft polymers in (B2) is preferably from 0.5% to 20% by weight, more preferably from 1% to 15% by weight and most preferably from 2% to 10% by weight.

Water

The liquid detergent compositions preferably comprise water. The water may be added to the composition directly or may be brought into the composition with raw materials. In any event, the total water content of the composition herein may comprise from 10% to 95% water by weight of the liquid dish detergent compositions. Alternatively, the composition may comprise from 20% to 95%, alternatively from 30% to 90%, or from 40% to 85% alternatively combinations thereof, of water by weight of the liquid dish detergent composition.

Organic Solvents

The present compositions may optionally comprise an organic solvent, different from the cyclic amine of Formula (I). Suitable organic solvents include $C_{4-14}$ ethers and diethers, polyols, glycols, alkoxylated glycols, $C_6$-$C_{16}$ glycol ethers, alkoxylated aromatic alcohols, aromatic alcohols, aliphatic linear or branched alcohols, alkoxylated aliphatic linear or branched alcohols, alkoxylated $C_1$-$C_5$ alcohols, $C_8$-$C_{14}$ alkyl and cycloalkyl hydrocarbons and halohydrocarbons, and mixtures thereof. Preferably the organic solvents include alcohols, glycols, and glycol ethers, alternatively alcohols and glycols. In one embodiment, the liquid detergent composition comprises from 0% to less than 50% of a solvent by weight of the composition. When present, the liquid detergent composition will contain from 0.01% to 20%, alternatively from 0.5% to 15%, alternatively from 1% to 10% by weight of the liquid detergent composition of said organic solvent. Non-limiting examples of specific solvents include propylene glycol, polypropylene glycol, propylene glycol phenyl ether, ethanol, and combinations thereof. In one embodiment, the composition comprises from 0.01% to 20% of an organic solvent by weight of the composition, wherein the organic solvent is selected from glycols, polyalkyleneglycols, glycol ethers, ethanol, and mixtures thereof.

Hydrotrope

The liquid detergent compositions optionally comprises a hydrotrope in an effective amount, i.e. from 0% to 15%, or from 0.5% to 10%, or from 1% to 6%, or from 0.1% to 3%, or combinations thereof, so that the liquid dish detergent compositions are compatible or more compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903. In one embodiment, the composition of the present invention is isotropic. An isotropic composition is distinguished from oil-in-water emulsions and lamellar phase compositions. Polarized light microscopy can assess whether the composition is isotropic. See e.g., *The Aqueous*

*Phase Behaviour of Surfactants*, Robert Laughlin, Academic Press, 1994, pp. 538-542. In one embodiment, an isotropic dish detergent composition is provided. In one embodiment, the composition comprises 0.1% to 3% of a hydrotrope by weight of the composition, preferably wherein the hydrotrope is selected from sodium, potassium, and ammonium xylene sulfonate, sodium, potassium and ammonium toluene sulfonate, sodium potassium and ammonium cumene sulfonate, and mixtures thereof.

Calcium/Magnesium Ions

Calcium ion and/or Magnesium ion, preferably Magnesium ion, are added, preferably as a hydroxide, chloride, acetate, sulphate, formate, oxide or nitrate salt, to the compositions of the present invention, typically at an active level of from 0.01% to 1.5%, preferably from 0.015% to 1%, more preferably from 0.025% to 0.5%, by weight of the liquid detergent composition. In one embodiment, the composition comprises from 0.01% to 1.5% of a calcium ion or magnesium ion, or mixtures thereof, by weight of the composition, preferably the magnesium ion.

Adjunct Ingredients

The liquid detergent compositions herein can optionally further comprise a number of other adjunct ingredients suitable for use in liquid detergent compositions such as perfume, colorants, pearlescent agents, opacifiers, suds stabilizers/boosters, cleaning and/or shine polymers, rheology modifying polymers, structurants, chelants, skin care actives, suspended particles, enzymes, anti-caking agents, viscosity trimming agents (e.g. salt such as NaCl and other mono-, di- and trivalent salts), preservatives and pH trimming and/or buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

Viscosity

The liquid detergent compositions of the present invention can be Newtonian or non-Newtonian with a viscosity of between 1 centipoises (cps) and 5,000 cps at 20° C. and, alternatively between 10 cps and 2,000 cps, or between 50 cps and 1,500 cps, or between 100 cps and 1,000 cps, alternatively combinations thereof.

Viscosity is measured with a BROOFIELD DV-E viscometer, at 20° C., spindle number 31. The following rotations per minute (rpm) should be used depending upon the viscosity: Between 300 cps to below 500 cps is at 50 rpm; between 500 cps to less than 1,000 cps is at 20 rpm; from 1,000 cps to less than 1,500 cps at 12 rpm; from 1,500 cps to less than 2,500 cps at 10 rpm; from 2,500 cps, and greater, at 5 rpm. Those viscosities below 300 cps are measured at 12 rpm with spindle number 18.

Packaging

The liquid detergent compositions of the present invention may be packed in any suitable packaging for delivering the liquid detergent composition for use. In one preferred embodiment, the package may be comprised of polyethylene terephthalate, high-density polyethylene, low-density polyethylene, or combinations thereof. Furthermore, preferably, the package may be dosed through a cap at the top of the package such that the composition exits the bottle through an opening in the cap. The cap may be a push-pull cap or a flip top cap.

The method of the invention comprises the steps of:

i) delivering a detergent composition in its neat form onto the dishware or a cleaning implement. By "neat form" is herein meant that the detergent composition is delivered onto the dishware or cleaning implement as it is, without previously diluting the composition with water.

ii) cleaning the dishware with the detergent composition in the presence of water. The water can be present by putting the dishware under a running tap, wetting the cleaning implement, etc and iii) optionally rinsing the dishware.

Alternative, the composition can be pre-dissolved in a sink of water to create a wash solution and the soiled dishware is immersed in the wash solution. The dishware can be subsequently rinsed.

Method of Washing

Other aspects of the invention are directed to methods of washing dishware with the composition of the present invention. Said methods comprise the step of applying the composition, preferably in liquid form, onto the dishware surface, either in diluted or neat form and rinsing or leaving the composition to dry on the surface without rinsing the surface.

By "in its neat form", it is meant herein that said composition is applied directly onto the surface to be treated and/or onto a cleaning device or implement such as a dish cloth, a sponge or a dish brush without undergoing any dilution (immediately) prior to the application. The cleaning device or implement is preferably wet before or after the composition is delivered to it. By "diluted form", it is meant herein that said composition is diluted by the user with an appropriate solvent, typically water. By "rinsing", it is meant herein contacting the dishware cleaned using a process according to the present invention with substantial quantities of appropriate solvent, typically water, after the step of applying the liquid composition herein onto said dishware. By "substantial quantities", it is meant usually about 1 to about 10 liters.

The composition herein can be applied in its diluted form. Soiled dishes are contacted with an effective amount, typically from about 0.5 ml to about 20 ml (per about 25 dishes being treated), preferably from about 3 ml to about 10 ml, of the detergent composition, preferably in liquid form, of the present invention diluted in water. The actual amount of detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. Generally, from about 0.01 ml to about 150 ml, preferably from about 3 ml to about 40 ml of a liquid detergent composition of the invention is combined with from about 2000 ml to about 20000 ml, more typically from about 5000 ml to about 15000 ml of water in a sink having a volumetric capacity in the range of from about 1000 ml to about 20000 ml, more typically from about 5000 ml to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Alternatively, the device may be immersed in a mixture of the hand dishwashing composition and water prior to being contacted with the dish surface, the concentrated solution is made by diluting the hand dishwashing composition with water in a small container that can accommodate the cleaning device at weight ratios ranging from about 95:5 to about 5:95, preferably about 80:20 to about 20:80 and more preferably about 70:30 to about 30:70, respectively, of hand dishwashing liquid:water respectively depending upon the user habits and the cleaning task.

Grease Cleaning Performance Test:

A polypropylene nonwoven substrate (SMS 60 g/sm—supplier: Avgol Nonwovens LTD) of dimensions 8 by 12 cm is homogeneously soiled with 5 g of a greasy soil of composition Lard+SV13 dye (supplier: Warwick Equest Ltd), and cut into pieces of 0.19 cm2.

The initial soil content is measured through image analysis (Verivide Digi-eye, D65 illuminant, Nikon D90 f/8.0 1/5s ISO200). A cut piece of the soiled substrate is washed under continuous agitation with 950 uL of a wash solution at a test detergent concentration in water of specified water hardness at 35° C. for 10 minutes, followed by 4 consecutive rinse cycles under agitation with 800 uL of demin water, each rinse cycle is 1 min in length.

The substrate is left to dry at 40° C. in an oven over night. The remaining soil level is re-measured using image analysis, and the % soil removal after versus before the wash process is calculated.

The test is replicated 8 times and the average % soil removal per test product at a given product concentration and water hardness is reported.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

Example 1: Grease Cleaning Performance Assessment

The following liquid detergent compositions have been prepared through mixing of the individual raw materials. Single variable comparisons of Baxxodur ECX210 cyclic diamine addition at two different levels, as well as a combination of Baxxodur ECX210 with an amphiphilic alkoxylated PEI polymer have been assessed following the grease cleaning protocol described herein above at a pH within (pH 8.0) and outside (pH 9.0) the scope of the invention. It was observed (% soil removal as a function of product concentration) that the single variable addition of Baxxodur ECX210, or the combined addition of Baxxodur ECX210 with an amphiphilic alkoxylated PEI polymer, leads to a more robust grease cleaning performance across different water hardnesses (2 dH and 15 dH), at a pH within scope pH (pH 8.0) than at a pH outside scope (pH 9.0). Examples A-D provide more robust grease cleaning across different water hardnesses than Comparative Examples A-D.

| | % active by weight of the composition | | | |
|---|---|---|---|---|
| | Example A | Example B | Example C | Example D |
| Code | pH 8 | pH 8 + 1% diamine | pH 8 + 2% diamine | pH 8 + 1% diamine + PEI |
| C1213 alkyl ethoxy (0.6) sulfate (AES) | 20.4 | 20.4 | 20.4 | 20.4 |
| C1214 dimethyl amine oxide (AO) | 6.8 | 6.8 | 6.8 | 6.8 |
| AES/AO - wt % ratio | 3/1 | 3/1 | 3/1 | 3/1 |
| Baxxodur ECX210 | — | 1.0 | 2.0 | 1.0 |
| $PEI600EO_{24}PO_{16}$ | — | — | — | 0.25 |
| NaCl | 1.0 | 1.0 | 1.0 | 1.0 |
| Polypropyleneglycol (MW 2000) | 1.0 | 1.0 | 1.0 | 1.0 |
| Ethanol | 10.0 | 10.0 | 10.0 | 10.0 |
| pH (10% dilution in demi water at 20° C.) - Adjust to desired pH with NaOH or HCl | 8 | 8 | 8 | 8 |
| Water and minors (dye, perfume, preservative | To 100% | To 100% | To 100% | To 100% |

| | % active by weight of the composition | | | |
|---|---|---|---|---|
| | Comparative Example A | Comparative Example B | Comparative Example C | Comparative Example D |
| Code | pH 9 | pH 9 + 1% diamine | pH 9 + 2% diamine | pH 9 + 1% diamine + PEI |
| C1213 alkyl ethoxy (0.6) sulfate (AES) | 20.4 | 20.4 | 20.4 | 20.4 |
| C1214 dimethyl amine oxide (AO) | 6.8 | 6.8 | 6.8 | 6.8 |
| AES/AO - wt % ratio | 3/1 | 3/1 | 3/1 | 3/1 |
| Baxxodur ECX210 | — | 1.0 | 2.0 | 1.0 |
| $PEI600EO_{24}PO_{16}$ | — | — | — | 0.25 |

-continued

| | % active by weight of the composition | | | |
|---|---|---|---|---|
| | Comparative Example A | Comparative Example B | Comparative Example C | Comparative Example D |
| NaCl | 1.0 | 1.0 | 1.0 | 1.0 |
| Polypropyleneglycol (MW 2000) | 1.0 | 1.0 | 1.0 | 1.0 |
| Ethanol | 10.0 | 10.0 | 10.0 | 10.0 |
| pH (10% dilution in demi water at 20° C.) - Adjust to desired pH with NaOH or HCl | 9 | 9 | 9 | 9 |
| Water and minors (dye, perfume, preservative | To 100% | To 100% | To 100% | To 100% |

PEI600EO24PO16: Polyethyleneimine backbone with MW about 600, comprising EO—terminal PO block polyalkoxylate side chains comprising each on average 24 EO and 16 PO units and hydrogen capped, MW 28000.

Baxxodur ECX210: mixture of 4-methylcyclohexane-1,3-diamine and 2-methylcyclohexane-1,3-diamine, available from BASF.

What is claimed is:

1. A liquid detergent composition having a pH of from 7.5 to 8.2 as measured at 10% solution in distilled water at 20° C. wherein the composition comprises about 10% to about 40% by weight of the composition of a surfactant system, the surfactant system comprising from 1% to 40% by weight of the composition of an anionic surfactant, wherein the anionic surfactant is an a C10-C13 alkyl ethoxylated sulfate surfactant having an average ethoxylation of from about 0.2 to about 1.0, and from 0.1% to 20% by weight of the composition of a primary co-surfactant, wherein the primary co-surfactant is an a C10-C14 alkyl dimethyl amine oxide, wherein the anionic surfactant and the primary co-surfactant are in a weight ratio of from 5:1 to 3:1 and wherein the composition further comprises from about 0.1 to about 5% by weight of the composition of a cyclic amine selected from the group consisting of 2-methylcyclohexane-1,3-diamine, 4-methyl cyclohexane-1,3-diamine and mixtures thereof.

2. A composition according to claim 1 wherein the surfactant system further comprises a secondary co-surfactant comprising an alkyl ethoxylated non-ionic surfactant.

3. A composition according to claim 2 wherein the secondary co-surfactant is an alkyl ethoxylated non-ionic surfactant comprising from 9 to 15 carbon atoms in its alkyl chain and from 5 to 12 units of ethylene oxide per mole of alcohol.

4. A composition according to claim 1 wherein the composition further comprises from about 0.1 to about 2% by weight of the composition of an amphiphilic polymer.

5. A composition according to claim 1 wherein the composition is a hand dishwashing detergent composition.

6. A method of manually washing dishware comprising the step of delivering a detergent composition according to claim 1 onto soiled dishware.

7. A composition according to claim 1 wherein the alkyl ethoxylated sulfate surfactant is branched and has an average level of branching of from about 5% to about 40%.

8. A composition according to claim 4 wherein the amphiphilic polymer is selected from the group consisting of amphiphilic alkoxylated polyalkyleneimine, amphiphilic graft polymer and mixtures thereof.

9. A composition according to claim 8 wherein the amphiphilic alkoxylated polyalkyleneimine is an alkoxylated polyethyleneimine polymer comprising a polyethyleneimine backbone having from about 400 to about 5,000 weight average molecular weight and the alkoxylated polyethyleneimine polymer further comprises:

(1) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a $C_1$-$C_4$ alkyl or mixtures thereof;

(2) an addition of one $C_1$-$C_4$ alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a $C_1$-$C_4$ alkyl or mixtures thereof; or (3) a combination thereof; and wherein the alkoxy moieties comprises ethoxy (EO) and/or propoxy (PO) and/or butoxy and wherein when the alkoxylation modification comprises EO it also comprises PO or BO.

* * * * *